US010358794B2

(12) United States Patent
Tanaka et al.

(10) Patent No.: US 10,358,794 B2
(45) Date of Patent: Jul. 23, 2019

(54) WORK VEHICLE

(71) Applicant: KCM Corporation, Hyogo (JP)

(72) Inventors: Tetsuji Tanaka, Abiko (JP); Yasunori Miyamoto, Ushiku (JP); Koji Hyodo, Kasumigaura (JP); Isamu Aoki, Tsukuba (JP); Katsuyuki Kirita, Ryugasaki (JP); Hiroaki Yada, Ryugasaki (JP); Seiji Nakagawa, Ryugasaki (JP); Masaki Yoshikawa, Kasama (JP)

(73) Assignee: KCM Corporation, Hyogo (JP)

( * ) Notice: Subject to any disclaimer, the term of this patent is extended or adjusted under 35 U.S.C. 154(b) by 337 days.

(21) Appl. No.: 15/122,208

(22) PCT Filed: May 13, 2015

(86) PCT No.: PCT/JP2015/063825
§ 371 (c)(1),
(2) Date: Aug. 29, 2016

(87) PCT Pub. No.: WO2015/174469
PCT Pub. Date: Nov. 19, 2015

(65) Prior Publication Data

US 2016/0369479 A1 Dec. 22, 2016

(30) Foreign Application Priority Data

May 14, 2014 (JP) ..... 2014-100742

(51) Int. Cl.
*E02F 9/20* (2006.01)
*E02F 3/34* (2006.01)
*E02F 3/43* (2006.01)

(52) U.S. Cl.
CPC ..... *E02F 9/2004* (2013.01); *E02F 3/34* (2013.01); *E02F 3/431* (2013.01); *E02F 9/2012* (2013.01)

(58) Field of Classification Search
CPC . E02F 3/431; E02F 3/434; E02F 3/845; E02F 3/847; E02F 3/907; E02F 9/2004; E02F 9/2012; E02F 9/264
(Continued)

(56) References Cited

U.S. PATENT DOCUMENTS 3,487,958 A 1/1970 Shook et al.

FOREIGN PATENT DOCUMENTS

CN 202298691 U 7/2012
DE 195 81 883 B4 9/2004
(Continued)

OTHER PUBLICATIONS

International Search Report (PCT/ISA/210) issued in PCT Application No. PCT/JP2015/063825 dated Jun. 9, 2015, with English translation (four (4) pages).

*Primary Examiner* — Saul Rodriguez
*Assistant Examiner* — Brendan P Tighe
(74) *Attorney, Agent, or Firm* — Crowell & Moring LLP

(57) ABSTRACT

A work vehicle, includes: a lift arm rotatably linked to a front portion of a vehicle body of a work vehicle so as to be allowed to swing along an up/down direction; an operation lever that can be operated within a range between a raising operation end position and a lowering operation end position, and is operated to raise and lower the lift arm; an up detent mechanism having a holding function for holding the operation lever at the raising operation end position once the operation lever is operated to the raising operation end position; and a down detent mechanism having a holding function for holding the operation lever at the lowering
(Continued)

operation end position once the operation lever is operated to the lowering operation end position, wherein: when an angle of the lift arm becomes greater than a predetermined upper limit, the holding function of the up detent mechanism and the holding function of the down detent mechanism are disengaged.

3 Claims, 9 Drawing Sheets

(58) Field of Classification Search
USPC ..... 414/685, 699, 700, 701
See application file for complete search history.

(56) References Cited

FOREIGN PATENT DOCUMENTS

| | | | | |
|---|---|---|---|---|
| EP | 2 508 681 | A2 | | 10/2012 |
| JP | 4-202919 | A | | 7/1992 |
| JP | 6-82153 | U | | 11/1994 |
| JP | 2004-36327 | A | | 2/2004 |
| JP | 2004036327 | A | * | 2/2004 |
| JP | 3724982 | B2 | | 12/2005 |
| JP | 2013-167099 | A | | 8/2013 |
| WO | WO 2008/153532 | A1 | | 12/2008 |

* cited by examiner

WORK VEHICLE

TECHNICAL FIELD

The present invention relates to a work vehicle that includes an operation lever having a detent function.

BACKGROUND ART

The work vehicle disclosed in PTL 1 has a detent function whereby as an operation lever operated to raise/lower a lift arm is set to a predetermined operation position (a raising operation end position or a lowering operation end position), the operation lever is held at the particular operation position. The operator of a work vehicle having such a detent function, which eliminates the need to be simultaneously engaged in, for instance, a lift arm raising operation and a traveling operation by allowing the lift arm to sustain a raised state with the operation lever held at the raising operation end position during a traveling operation, is able to focus on the traveling operation.

CITATION LIST

Patent Literature

PTL 1: Japanese Laid Open Patent Publication No. 2013-167099

SUMMARY OF INVENTION

Technical Problem

If the angle of the lift arm exceeds a predetermined upper limit while the operation lever is held at the raising operation end position, the detent function is automatically disengaged. The operation lever includes springs and the like used to hold the operation lever at a neutral position, and thus the detent function for holding the raising operation end position is disengaged, the force imparted from the spring and the like moves the operation lever back toward the neutral position.

However, the operation lever may not always stop at the neutral position and instead may move to a point close to the operation end position on the opposite side (i.e., to the lowering operation end position). Under such circumstances, the detent function will be engaged on the lowering side, resulting in the operation lever being held at the lowering operation end position and the lift arm set in a lowering operation state against the intention of the operator. Consequently, the operator will be disconcerted and the operability of the work vehicle will be compromised.

Solution to Problem

According to the 1st aspect of the present invention, a work vehicle comprises: a lift arm rotatably linked to a front portion of a vehicle body of a work vehicle so as to be allowed to swing along an up/down direction; an operation lever that can be operated within a range between a raising operation end position and a lowering operation end position, and is operated to raise and lower the lift arm; an up detent mechanism having a holding function for holding the operation lever at the raising operation end position once the operation lever is operated to the raising operation end position; and a down detent mechanism having a holding function for holding the operation lever at the lowering operation end position once the operation lever is operated to the lowering operation end position, wherein: when an angle of the lift arm becomes greater than a predetermined upper limit, the holding function of the up detent mechanism and the holding function of the down detent mechanism are disengaged.

According to the 2nd aspect of the present invention, in the work vehicle according to the 1st aspect, it is preferred that the work vehicle further comprises: an arm angle sensor that detects the angle of the lift arm; and a control unit that disengages the holding function of the up detent mechanism and the holding function of the down detent mechanism over a first predetermined time length once the angle detected by the arm angle sensor becomes greater than the predetermined upper limit and re-engages the holding function of the down detent mechanism when the first predetermined time length elapses.

According to the 3rd aspect of the present invention, in the work vehicle according to the 2nd aspect, it is preferred that the control unit disengages the holding function of the up detent mechanism and the holding function of the down detent mechanism over a second predetermined time length once the angle detected by the arm angle sensor becomes less than a predetermined lower limit and re-engages the holding function of the up detent mechanism when the second predetermined time length elapses.

According to the 4th aspect of the present invention, in the work vehicle according to the 1st aspect, it is preferred that the up detent mechanism includes an up detent coil that holds the operation lever at the raising operation end position with magnetic force; the down detent mechanism includes a down detent coil that holds the operation lever at the lowering operation end position with magnetic force; and the work vehicle further comprises a detent control circuit that sets the up detent coil and the down detent coil in a power supply on state when the angle of the lift arm is less than the predetermined upper limit and cuts off power supply to the up detent coil and the down detent coil once the angle of the lift arm becomes greater than the predetermined upper limit.

According to the 5th aspect of the present invention, in the work vehicle according to the 4th aspect, it is preferred that the detent control circuit includes a proximity switch that is set in an on state when the angle is less than the predetermined upper limit and enters an off state once the angle becomes greater than the predetermined upper limit, and a relay that controls power supply to the up detent coil and the down detent coil by interlocking with the on/off state of the proximity switch.

Advantageous Effects of Invention

According to the present invention, an improvement in the work vehicle operability is achieved.

DESCRIPTION OF EMBODIMENTS

Figure 1:
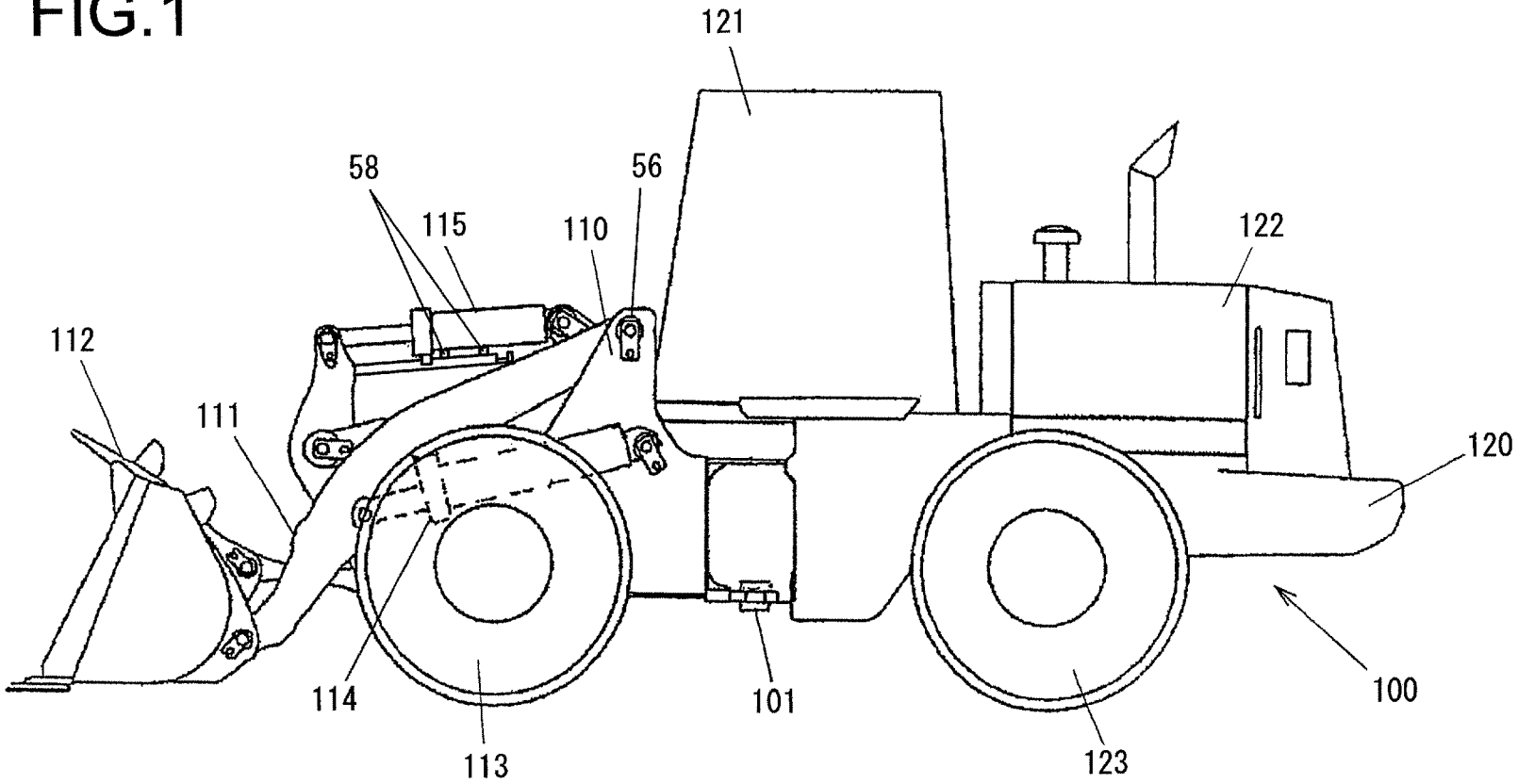
FIG. 1 A side elevation of a wheel loader achieved as an embodiment of the work vehicle according to the present invention FIG. 2 A schematic illustration showing operation members disposed inside the operator's cab 121 of the wheel loader 100

The following is a description of an embodiment of the present invention, given in reference to drawings. FIG. 1 is a side elevation of a wheel loader achieved as an embodiment of the work vehicle according to the present invention. A wheel loader 100 includes a front body 110 at which a lift arm 111, a bucket 112, tires 113 and the like are disposed and a rear body 120 at which an operator's cab 121, an engine compartment 122, tires 123 and the like are disposed.

The lift arm (hereafter simply referred to as an "arm") 111, rotatably mounted so as to be allowed to swing up/down relative to the front body 110, is rotatably driven via an arm cylinder 114. The bucket 112, rotatably mounted at the front end of the arm 111 so that it is allowed to pivot forward/backward inclining direction (up/down), is rotatably driven via a bucket cylinder 115. The front body 110 and the rear body 120 are connected with each other via a center pin 101 so as to articulate freely relative to each other, and as a steering cylinder (not shown) extends/contracts, the front body 110 pivots to the left or to the right relative to the rear body 120.

An arm angle sensor 56, which detects the rotational angle of the arm 111 relative to the front body 110, is disposed at a rotating portion of the arm 111, whereas a stroke quantity detection device 58 that detects the stroke length at the bucket cylinder 115, representing the rotational angle of the bucket 112 relative to the arm 111, is disposed at the bucket cylinder 115.

Figure 2:
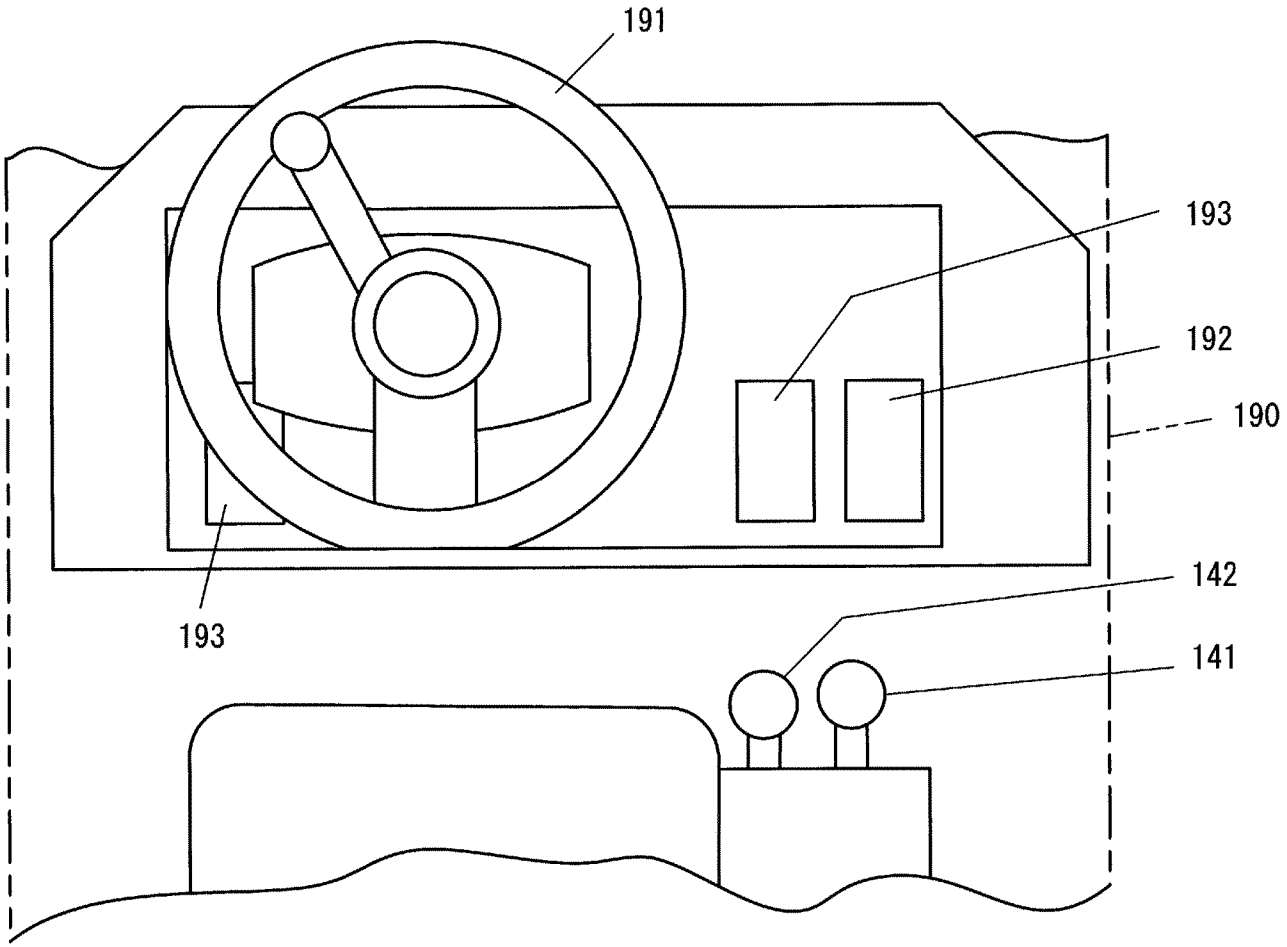

FIG. 2 is a schematic illustration showing the operation members disposed inside the operator's cab 121 of the wheel loader 100. A steering wheel 191 operated by the driver to steer the wheel loader 100, an accelerator pedal 192, a pair of interlocking brake pedals 193, i.e., a left brake pedal and a right brake pedal that interlock with each other, an arm operation lever 141 operated to swing the arm 111 along the upward direction or along the downward direction, and a bucket operation lever 142 operated to rotate the bucket 112 along a backward inclining direction (upward) or along a forward inclining direction (downward) are disposed in the operator's cab 121. Rotation of the bucket 112 in the backward inclining direction may also be referred to as a tilting motion. Rotation of the bucket 112 in the forward inclining direction may also be referred to as a dumping motion.

Figure 3:
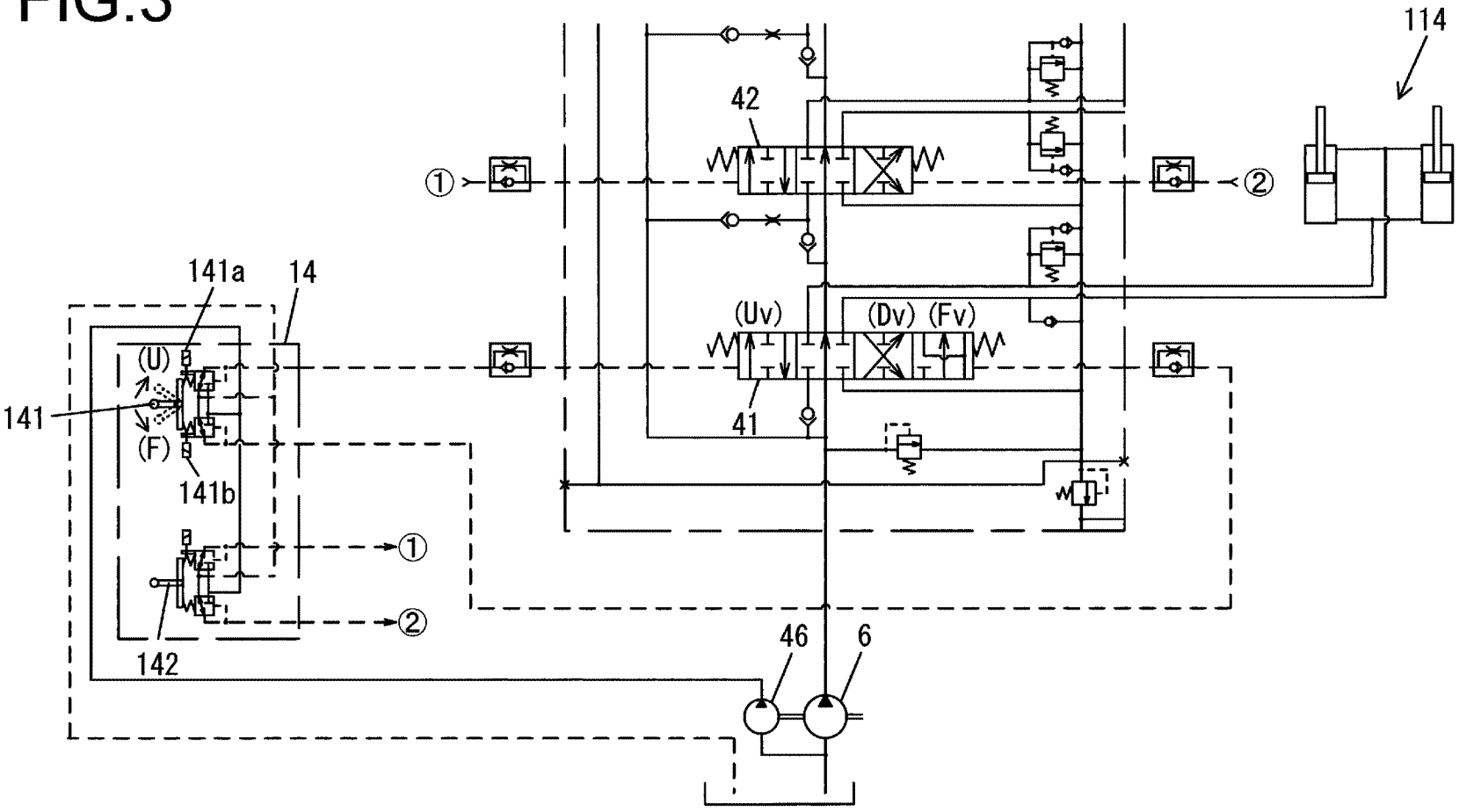
FIG. 3 A diagram of the work hydraulic circuit in the wheel loader 100

The work vehicle according to the present invention is characterized in a detent function of the arm operation lever 141. First, in reference to FIG. 3, the hydraulic circuit through which the arm 111 is made to swing upward or downward will be described. FIG. 3 shows the work hydraulic circuit in the wheel loader 100, which includes a hydraulic circuit for the arm 111 and a hydraulic circuit for the bucket 112.

The hydraulic circuit shown in FIG. 3 includes an arm control valve 41, via which drive of the arm cylinder 114 is controlled by controlling the direction and the flow rate of the pressure oil provided from a main pump 6 to the arm cylinder 114, and a bucket control valve 42, via which drive of the bucket cylinder is controlled by controlling the direction and the flow rate of the pressure oil provided from the main pump 6 to the bucket cylinder (not shown). The operation of the arm control valve 41 is controlled via the arm operation lever 141 located at a pilot valve 14. The operation of the bucket control valve 42 is controlled via the bucket operation lever 142 located at the pilot valve 14.

The following explanation will focus on the hydraulic circuit for the arm 111. At the pilot valve 14, the pressure of the pressure oil output from a pilot pump 46 is adjusted to a pilot pressure corresponding to an operation quantity at the arm operation lever 141, and the pressure oil achieving the pilot pressure is then provided to the arm control valve 41. The arm control valve 41 is a control valve that controls the direction and the flow rate of the pressure oil to be delivered to the arm cylinder 114 by adjusting the spool stroke quantity, in correspondence to the pilot pressure (an arm raising pilot pressure and an arm lowering pilot pressure).

As FIG. 3 shows, when the arm operation lever 141 is set at the neutral position, the arm control valve 41 is controlled so as to assume the neutral position indicated in FIG. 3. As the arm operation lever 141 in the state shown in FIG. 3 is operated toward a raising operation end position (U), the arm control valve 41 is switched from the neutral position toward an arm up position (Uv). As a result, the cylinder rod in the arm cylinder 114 extends, and the arm 111 shown in FIG. 1 is rotationally driven upward.

As the arm operation lever 141 in the state shown in FIG. 3 is operated toward a lowering operation end position (F), i.e., to a position between the neutral position and the lowering operation end position (F), the arm control valve 41 is switched from the neutral position toward an arm down position (Dv). As a result, the cylinder rod in the arm cylinder 114 contracts and the arm 111 is rotationally driven downward.

As the arm operation lever 141 in the state shown in FIG. 3 is operated to the lowering operation end position (F), the arm control valve 41 is switched to a float position (Fv). As a result, the arm 111 enters a state of free fall, and once the bucket 112 contacts the ground, the arm 111 rebounds freely under the influence of external forces.

Figure 4:
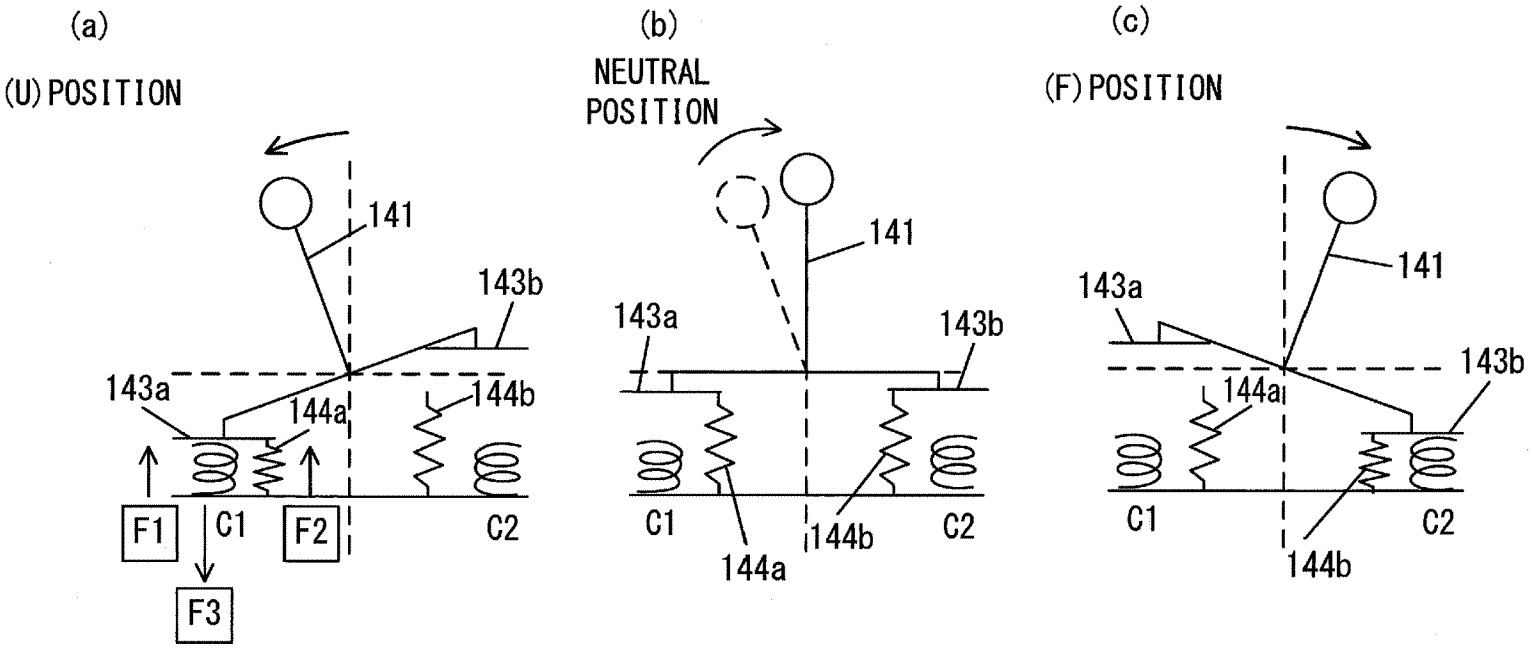
FIG. 4 Illustrations of detent mechanisms 141*a* and 141*b*, respectively configured with detent coils C1 and C2

As FIG. 3 shows, the arm operation lever 141 includes detent mechanisms 141*a* and 141*b* each used to hold the arm operation lever 141 at a predetermined operation position. While detent mechanisms adopting any of various structures may be used, the detent mechanisms 141*a* and 141*b* in the embodiment each attract and hold the arm operation lever 141 with the magnetic force imparted from an electromagnet, as shown in FIG. 4. C1 and C2 indicate solenoid coils of electromagnets in the detent mechanisms 141*a* and 141*b*, and they will be referred to as detent coils C1 and C2 in the description of the embodiment.

As shown in FIG. 4, springs 144*a* and 144*b*, used to hold the arm operation lever 141 at the neutral position, are disposed at the arm operation lever 141, and the arm operation lever 141 assumes the neutral position, as shown in FIG. 4(*b*), in a stationary state in which the arm 111 is not raised or lowered.

An electric current is supplied to the detent coils C1 and C2 in the detent mechanisms 141*a* and 141*b*, and as the arm operation lever 141 at the neutral position is operated to the raising operation end position (U) or to a position near the raising operation end position (U), a draw portion 143*a* is pulled toward and held at the electromagnet in the detent mechanism 141*a*, as illustrated in FIG. 4(*a*), and as a result, the arm operation lever 141 is held at the raising operation end position (U). The arm control valve 41 is thus held at the arm up position (Uv), and the arm 111 is rotationally driven along the upward direction even if the driver releases the arm operation lever 141.

Under these conditions, a hydraulic reaction force F1 attributable to a primary pilot pressure and a secondary pilot pressure, a repulsive force F2 imparted from the spring 144*a* and an electromagnetic attractive force F3 generated at the detent mechanism 141*a* are at work at the arm operation lever 141, and since the magnetic force is set so that F3>F1+F2, the arm operation lever 141 is held at the raising operation end position (U).

If, on the other hand, the arm operation lever 141 at the neutral position is operated to a lowering operation end position (D) or to a position near the lowering operation end position, a draw portion 143*b* is pulled toward and held at the electromagnet in the detent mechanism 141*b* and the arm operation lever 141 is thus held at the lowering operations end position (F), as illustrated in FIG. 4(*c*). Once the arm operation lever 141 is held at the lowering operation end position (F), the arm control valve 41 is switched to and held at the float position (Fv). As a result, the arm 111 enters a state of free fall, and once the bucket 112 contacts the ground, the arm 111 rebounds freely under the influence of external forces. In this situation, too, the hydraulic reaction force F1 attributable to the pilot pressures, a reaction force F2 imparted by the spring 144*b* and an electromagnetic attractive force F3 generated at the detent mechanism 141*b* are at work at the arm operation lever 141, and the magnetic force is set so that F3>F1+F2.

Once the arm 111 is raised beyond a predetermined upper limit height, i.e., once the arm angle exceeds a predetermined upper limit value, the electromagnetic hold achieved by the detent mechanism 141*a* is released. In addition, as the arm 111 is lowered to a position lower than a predetermined lower limit height, i.e., once the arm angle becomes less than a predetermined lower limit value, the electromagnetic hold achieved by the detent mechanism 141*b* is released.

If the power supply to the detent coil C1 or the detent coil C2 stops while the arm operation lever 141 is electromagnetically held, there is no longer any electromagnetic attractive force F3 at work at the arm operation lever 141, the electromagnetic hold achieved via the detent mechanism 141*a* or 141*b* is released and the force (F1+F2) moves the arm operation lever 141 back to the neutral position. Once the arm operation lever 141 resumes the neutral position, the arm control valve 41 is switched to the neutral position (Nv) and the swinging motion of the arm 111 stops.

As described earlier, a relatively large mass is formed at the front end of each of the operation levers 141 and 142 where grips or the like are disposed, and for this reason, the operation levers 141 and 142 may move toward the operation end positions on the opposite side due to inertia instead of stopping at their respective neutral positions when power supply to the detent coils C1 or the detent coils C2 stops.

For instance, if the power supply to the detent coil C1 stops to release the hold on the arm operation lever 141 held at the raising operation end position (U) as shown in FIG. 4(*a*), the arm operation lever 141 may move beyond the neutral position to a point near the lowering operation end position (F). In this situation, power supply to the detent coil C2 is on and thus, the draw portion 143*b* will be pulled toward and held at the electromagnet due to the magnetic force imparted from the detent coil C2. Consequently, the arm control valve 41 will be switched to the float position (Fv), causing free fall of the arm 111.

In order to address this issue, a control unit 10 controls power supply to the detent coils C1 and C2 as described below in the embodiment so as to prevent the arm operation lever 141 from becoming held at the opposite operation end position upon release of the detent function.

Figure 5:
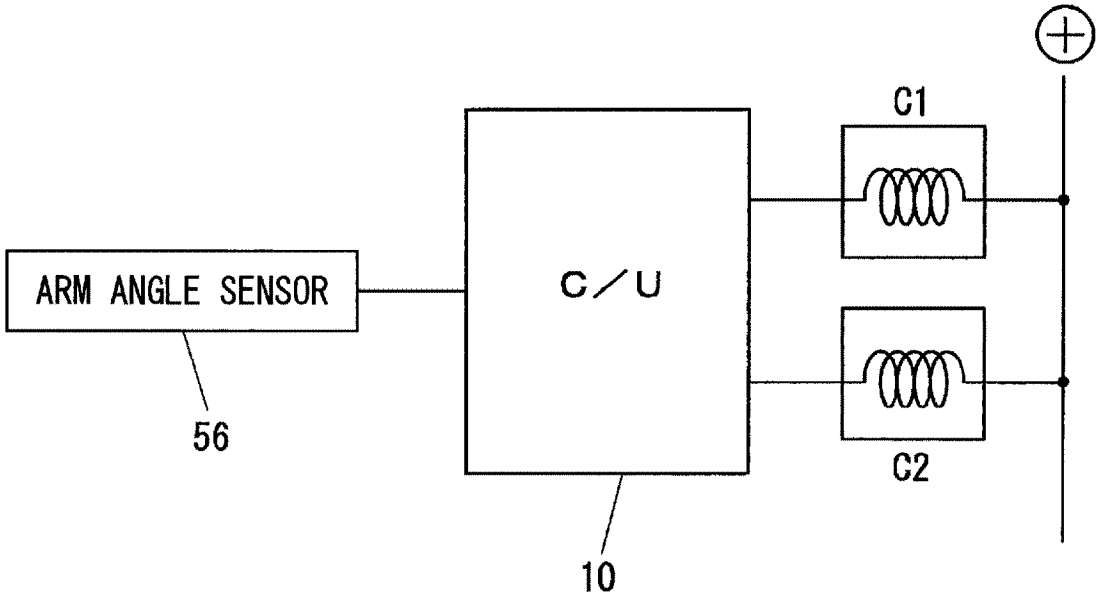
FIG. 5 A block diagram of the control system engaged in control of power supply to the detent coils C1 and C2

FIG. 5 is a block diagram of the control system engaged in the power supply control under which power is supplied to the detent coils C1 and C2. A signal from the arm angle sensor 56 is input to the control unit 10 in the wheel loader 100. The control unit 10 controls power supply to the detent coils C1 and C2 based upon the signal provided from the arm angle sensor 56. As long as the angle of the arm 111 is between the predetermined upper limit value and the predetermined lower limit value, the control unit 10 allows power to be supplied to the detent coils C1 and C2.

Figure 6:
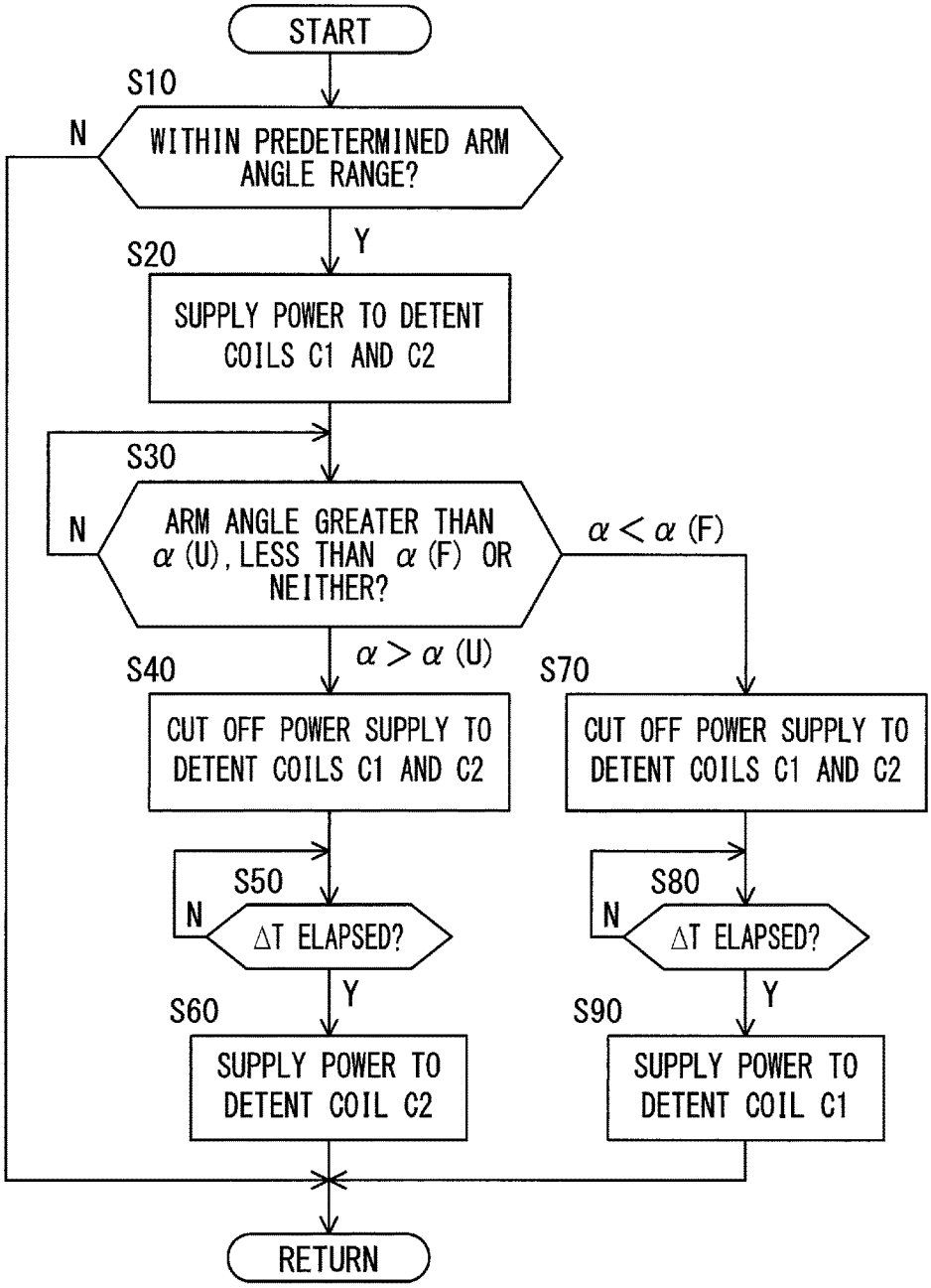
FIG. 6 A flowchart of the power supply control executed in the control unit 10 to control supply of power to the detent coils C1 and C2

Once the arm angle becomes greater than the predetermined upper limit value or less than the predetermined lower limit value, control such as that shown in FIG. 6 is executed. FIG. 6 is a flowchart of the power supply control executed by the control unit 10 to control the power supply to the detent coils C1 and C2.

In step S10, a decision is made as to whether or not the arm angle $\alpha$ is within a predetermined range ($\alpha(U) \geq \alpha \geq \alpha(F)$). The angle $\alpha(U)$ takes the predetermined upper limit value mentioned earlier, whereas the angle $\alpha(F)$ takes the predetermined lower limit value mentioned earlier. If it is decided in step S10 that the arm angle is outside the predetermined range, the processing in FIG. 6 ends.

If it is decided in step S10 that the arm angle $\alpha$ falls into the predetermined range, the operation proceeds to step S20 and the detent coils C1 and C2 are both set in a power on state. In step S30, a decision is made with regard to the arm angle $\alpha$, i.e., that the arm angle $\alpha$ is greater than the predetermined upper limit value $\alpha(U)$, that the arm angle $\alpha$ is less than the predetermined lower limit value $\alpha(F)$ or that it is neither (it falls into the predetermined range ($\alpha(U) \geq \alpha \geq \alpha(F)$). If a "neither" (N) decision is made, the processing in step S30 is executed again.

If it is decided in step S30 that the arm angle $\alpha$ is greater than the predetermined upper limit value $\alpha(U)$, the operation proceeds to step S40. In step S40, the power supply to the detent coils C1 and C2 is turned off. In the following step S50, a decision is made as to whether or not a predetermined length of time $\Delta t$ has elapsed since the power supply was turned off in step S40. The predetermined length of time $\Delta t$ may be set to, for instance, the length of time taken by the arm operation lever 141 to move back to the neutral position after the power supply to the detent coils C1 and C2 is turned off, the length of time that elapses before the deflection (or deviation) width centered on the neutral position of the arm operation lever 141 becomes small enough so that the arm operation lever 141 does not become held at the detent at the operation end position on the opposite side, or the like. Once it is decided that the predetermined length of time $\Delta t$ has elapsed following the power off, the operation proceeds from step S50 to step S60 to resume power supply to the detent coil C2 before the processing in FIG. 6 ends. While the predetermined length of time $\Delta t$ is typically set to approximately one second, it may be set to a different value.

If, on the other hand, it is decided in step S30 that the arm angle $\alpha$ is less than the predetermined lower limit value $\alpha(F)$, the operation proceeds to step S70. In step S70, the power supply to the detent coils C1 and C2 is turned off. In the following step S80, a decision is made as to whether or not a predetermined length of time $\Delta t$ has elapsed since the power supply was turned off. If it is decided in step S80 that the predetermined length of time Δt has elapsed following the power off, the operation proceeds to step S90 to resume power supply to the detent coil C1 before the processing in FIG. 6 ends.

In the work vehicle achieved in the embodiment as described above, the arm operation lever 141, via which the arm 111 is raised or lowered, can be operated over the range between the raising operation end position (U) and the lowering operation end position (F). The arm operation lever 141 includes the detent mechanism 141*a*, having a holding function for holding the arm operation lever 141 at the raising operation end position (U) once it has been operated to the raising operation end position (U), and the detent mechanism 141*b* having a holding function for holding the arm operation lever 141 at the lowering operation end position (F) once it has been operated to the lowering operation end position (F). When the arm angle becomes greater than the predetermined upper limit value α(U), the holding function of the detent mechanism 141*a* and the holding function of the detent mechanism 141*b* are disengaged.

Namely, once the arm angle becomes greater than the predetermined upper limit value α(U) and the holding function of the detent mechanism 141*a* is disengaged, the holding function of the detent mechanism 141*b* at the lowering operation end position (F), too, is disengaged. Thus, even if the arm operation lever 141 moves beyond the neutral position and deflects (or deviates) toward the lowering operation end position (F) to a significant extent, the arm operation lever 141 will not be held by the detent mechanism 141*b* at the lowering operation end position (F).

The structure achieved in the embodiment includes the arm angle sensor 56 that detects the arm angle and the control unit 10 that disengages the holding function of the up detent mechanism 141*a* and the holding function of the down detent mechanism 141*b* over the predetermined length of time Δt if the angle detected by the arm angle sensor 56 becomes greater than the predetermined upper limit value α(U) and re-engages the holding function of the down detent mechanism 141*b* once the predetermined length of time Δt elapses. Once the predetermined length of time Δt elapses, the extent to which the arm operation lever 141 deflects (or deviates) becomes small enough and thus, the arm operation lever 141 will not be held by the down detent mechanism 141*b*.

In addition, if the arm angle becomes less than the predetermined lower limit value α(F), the holding function of the up detent mechanism 141*a* and the holding function of the down detent mechanism 141*b* are disengaged over the predetermined length of time Δt and once the predetermined length of time Δt elapses, the holding function of the up detent mechanism 141*a* is re-engaged. Thus, the risk of the arm operation lever 141 becoming held by the detent mechanism 141*a* at the raising operation end position (U) when the arm angle becomes less than the predetermined lower limit value α(F) and the holding function of the down detent mechanism 141*b* is disengaged is eliminated.

(Variations)

It is to be noted that power supply to the detent coils C1 and C2 is controlled via the control unit 10, as shown in FIG. 6, so as to ensure that the arm operation lever 141 is never held at the operation end position on the other side in the embodiment described above. However, similar advantages and operations may be achieved by configuring the power supply circuit for the detent coils C1 and C2 as illustrated in FIG. 7 instead of controlling the power supply via the control unit 10.

Figure 7:
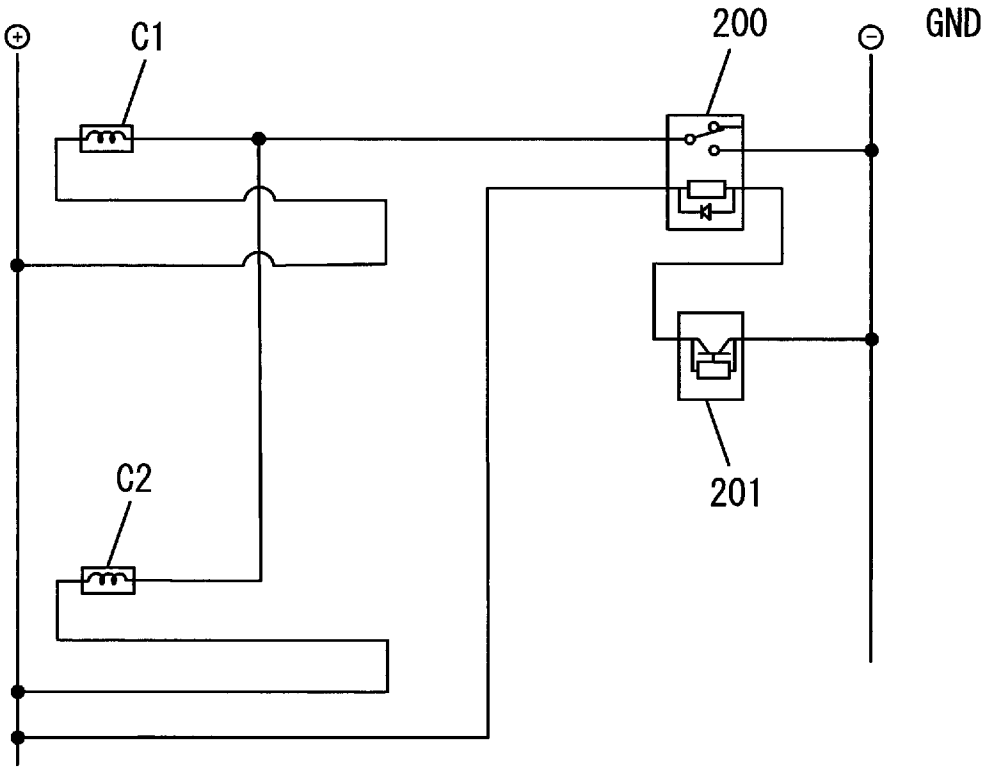
FIG. 7 A diagram of a power supply circuit through which power is supplied to the detent coils C1 and C2 in a variation FIG. 8 A diagram indicating the detent engagement range achieved in the variation FIG. 9 A flowchart of the power supply control executed in the variation

The power supply circuit shown in FIG. 7 includes a proximity switch 201 disposed at the arm 111, via which a decision is made as to whether or not the arm angle is greater than the predetermined upper limit value α(U). The proximity switch 201, which rotates together with the arm 111, detects, for instance, a detection target member assuming a circular-arc shape, fixed to the rotating shaft of the arm 111. The circular arc-shaped detection target member forms a circular arc corresponding to the up detent engagement range (=the down detent engagement range) shown in FIG. 8, and the proximity switch 201 in FIG. 7 faces opposite the detection target member and enters an on state over the up detent engagement range. Once the arm moves beyond the position at which the arm angle reaches the predetermined upper limit value α(U) (the up detent-release setting position in FIG. 8), the proximity switch 201 no longer faces opposite the detection target member and enters an off state.

When the proximity switch 201 is in the on state, a relay 200 is closed and the detent coils C1 and C2 are in a power on state. As the proximity switch 201 enters the off state, the relay 200 opens, thereby cutting off the power supply to the detent coils C1 and C2. Even when the power supply to the detent coil C1 is cut off at the up detent-release setting position and the arm operation lever 141 deflects (or deviates) by a great extent toward the operation end position (lowering operation end position) on the opposite side beyond the neutral position, the arm operation lever 141 does not become held at the lowering operation end position, since power supply to the detent coil C2 is also cut off.

Figure 8:
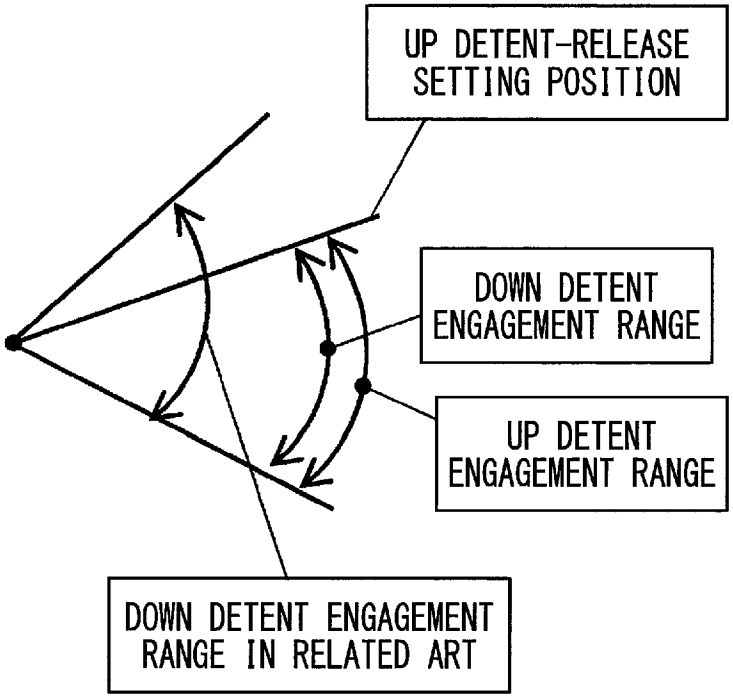

While a circuit capable of executing the operation illustrated in FIG. 8 is configured in the variation in FIG. 7 by connecting the relay 200 to the ground side of the detent coils C1 and C2, which are connected in parallel, and turning the proximity switch 201 on/off in order to open/close the relay 200, the relay 200 may instead be disposed on the positive side of the detent coils C1 and C2. The structure configured with the relay circuit, which does not include an expensive control unit 10, makes it possible to keep down the manufacturing costs.

As a further alternative, on/off signals output from the proximity switch 201 may be input to the control unit 10 and power supply to the detent coils C1 and C2 may be turned on/off via the control unit 10. In this case, the arm angle sensor 56 in the block diagram in FIG. 5 should be replaced by the proximity switch 201.

Figure 9:
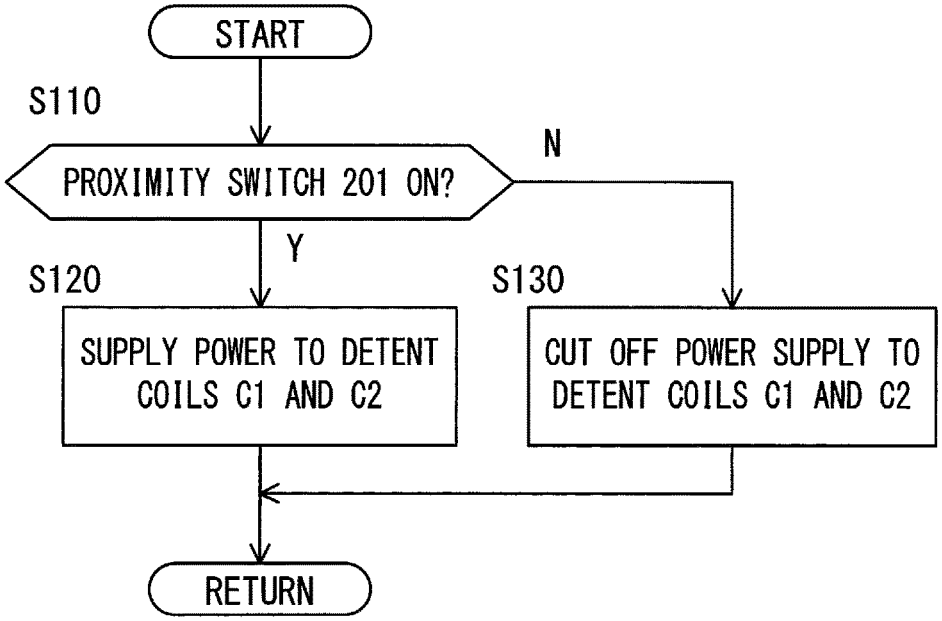

FIG. 9 presents a flowchart of the control executed in such an alternative configuration. The control is repeatedly executed over predetermined time intervals. In step S110, a decision is made as to whether or not the proximity switch 201 is in the on state, i.e., whether or not the arm is at a position within the down detent engagement range (=the up detent engagement range) in FIG. 8. Upon deciding in step S110 that the proximity switch 201 is in the on state, the operation proceeds to step S120 to set the detent coils C1 and C2 in the power on state. If, on the other hand, it is decided in step S110 that the proximity switch 201 is not in the on state (i.e., the proximity switch 201 is in the off state) the operation proceeds to step S130 to cut off the power supply to the detent coils C1 and C2. Since the power supply to both detent coils C1 and C2 is cut off once the angle of the arm 111 becomes greater than the up detent-release setting value, as described above, it can be ensured that the arm operation lever 141 does not become held at the lowering operation end position on the opposite side upon an up detent release.

It is to be noted that while an explanation has been given in reference to the wheel loader achieved in the embodiment on an example in which the present invention is adopted in an arm operation lever that includes the up detent mechanism 141*a* and the down detent mechanism 141*b*, the present invention may be likewise adopted in any work vehicle that includes an operation lever with detent mechanisms each disposed at one of the two operation end positions.

In addition, when an operation lever is constituted with a hydraulic pressure reducing valve, a hydraulic pressure corresponding to the operation angle or the stroke of the operation lever is output from the pressure reducing valve as a secondary pressure and the spool in a control valve is displaced in correspondence to the secondary pressure. In the case of an electric operation lever, hydraulic pressure corresponding to the operation angle or the stroke of the operation lever is output from a proportional solenoid valve and the spool in the control valve is displaced based upon the hydraulic pressure output from the proportional solenoid valve.

As explained earlier, the arm operation lever 141 is a grip-type lever having a grip formed at the front end thereof. This means that it tends to deflect (or deviate) to a great extent toward the opposite side beyond the neutral point when a detent is released. In addition, a switch (a single switch or a plurality of switches) related to operations other than the arm operation may be disposed at the grip, and in such a case, the extent of deflection (or deviation) toward the opposite side is likely to increase due to inertia. A switch disposed at the grip may be, for instance, an F-N-R switch or a travel direction switch operated to switch the advancing direction of the work vehicle. Furthermore, the present invention may also be adopted in an operation lever turned forward/backward for an arm operation and turned to the left/right for a bucket operation.

It is to be noted that the embodiment described above simply represents an example, and the present invention is in no way limited to the particulars of the embodiment. Any other modes conceivable within the scope of the technical teachings of the present invention are also considered within the scope of the present invention. For instance, while the present invention is adopted both when the arm angle $\alpha$ exceeds the predetermined upper limit value $\alpha(U)$ and when the arm angle $\alpha$ becomes less than the predetermined lower limit value $\alpha(F)$, as shown in FIG. 6 in the embodiment described above, the present invention may be adopted only in either situation.

The disclosure of the following priority application is herein incorporated by reference:

Japanese Patent Application No. 2014-100742 filed May 14, 2014

REFERENCE SIGNS LIST

10 . . . control unit (control unit, detent control circuit), 14 . . . pilot valve, 41 . . . arm control valve, 56 . . . arm angle sensor, 100 . . . wheel loader (work vehicle), 111 . . . lift arm (arm), 141 . . . arm operation lever (operation lever), 141*a* . . . detent mechanism (up detent mechanism), 141*b* . . . detent mechanism (down detent mechanism), 144*a*, 144*b* . . . spring, 200 . . . relay (detent control circuit), 201 . . . proximity switch (detent control circuit), C1 . . . detent coil (up detent coil), C2 . . . detent coil (down detent coil)

The invention claimed is:

1. A work vehicle, composed of a front body and a rear body comprising:

a lift arm rotatably linked to a front portion of the front body so as to be allowed to swing along an up/down direction;

an operation lever that can be operated within a range between a raising operation end position and a lowering operation end position, and is operated to raise and lower the lift arm;

an up detent mechanism having a holding function for holding the operation lever at the raising operation end position once the operation lever is operated to the raising operation end position; and a down detent mechanism having a holding function for holding the operation lever at the lowering operation end position once the operation lever is operated to the lowering operation end position, wherein:

when an angle of the lift arm with respect to the front body becomes greater than a predetermined upper limit, the holding function of the up detent mechanism and the holding function of the down detent mechanism are disengaged;

an arm angle sensor that detects the angle of the lift arm; and a control unit that disengages the holding function of the up detent mechanism and the holding function of the down detent mechanism over a first predetermined time length once the angle detected by the arm angle sensor becomes greater than the predetermined upper limit and re-engages the holding function of the down detent mechanism when the first predetermined time length elapses.

2. The work vehicle according to claim 1, wherein:

the control unit disengages the holding function of the up detent mechanism and the holding function of the down detent mechanism over a second predetermined time length once the angle detected by the arm angle sensor becomes less than a predetermined lower limit and re-engages the holding function of the up detent mechanism when the second predetermined time length elapses.

3. The work vehicle according to claim 1, wherein:

the up detent mechanism includes an up detent coil that holds the operation lever at the raising operation end position with magnetic force;

the down detent mechanism includes a down detent coil that holds the operation lever at the lowering operation end position with magnetic force; and the work vehicle further comprises a detent control circuit that sets the up detent coil and the down detent coil in a power supply on state when the angle of the lift arm is less than the predetermined upper limit and cuts off power supply to the up detent coil and the down detent coil once the angle of the lift arm becomes greater than the predetermined upper limit.

* * * * *